US005456241A

United States Patent [19]

Ward

[11] Patent Number: 5,456,241

[45] Date of Patent: Oct. 10, 1995

[54] OPTIMIZED HIGH POWER HIGH ENERGY IGNITION SYSTEM

[75] Inventor: Michael A. V. Ward, Lexington, Mass.

[73] Assignee: Combustion Electromagnetics, Inc., Arlington, Mass.

[21] Appl. No.: 148,555

[22] Filed: Nov. 8, 1993

Related U.S. Application Data

[63] Continuation-in-part of Ser. No. 66,868, May 25, 1993, abandoned.

[51] Int. Cl.[6] ..... F02P 3/06

[52] U.S. Cl. ..... 173/598; 123/169 EL; 123/606; 123/637; 313/138; 313/139

[58] Field of Search ..... 123/169 R, 169 EL, 123/169 G, 596, 598, 606, 634, 637; 313/138, 139, 140

[56] References Cited

U.S. PATENT DOCUMENTS

| | | | |
|---|---|---|---|
| 1,326,599 | 12/1919 | Kelsey et al. | 313/138 X |
| 3,312,848 | 4/1967 | Baum | 313/138 X |
| 3,502,055 | 3/1970 | Beesch | 123/169 EL |
| 3,693,607 | 9/1972 | Pasbrig | 123/169 EL |
| 3,710,772 | 1/1973 | Warner | 123/169 R |
| 4,364,342 | 12/1982 | Asik | 123/169 R |
| 4,841,925 | 6/1989 | Ward | 123/169 PA |
| 5,131,376 | 7/1992 | Ward | 123/598 |
| 5,179,928 | 1/1993 | Cour et al. | 123/606 |
| 5,207,208 | 5/1993 | Ward | 123/596 |
| 5,315,982 | 5/1994 | Ward et al. | 123/634 |

*Primary Examiner*—Tony M. Argenbright
*Attorney, Agent, or Firm*—Jerry Cohen

[57] ABSTRACT

A high power high energy ignition system for internal combustion engines using an energy storage capacitor (4), resonating inductor (3) and one or more coils Ti with switches Si for each coil Ti. The system is designed and optimized according to the transient voltage doubling formulation and certain coil magnetic flux formulations to produce a very high power, very high energy, high efficiency ignition powered and controlled by a power converter (14) and controller (15) to produce an initial high frequency spark pulse followed by moderate firing longer duration spark pulses or continuously firing spark oscillations for delivery to the air-fuel mixture of an engine with total spark energy approximately independent of engine speed. The energy is delivered by means of a toroidal gapped spark plug (46) with extended electrodes (48*a*) to maximize ignition kernel size and minimize spark plug erosion and fouling.

36 Claims, 7 Drawing Sheets

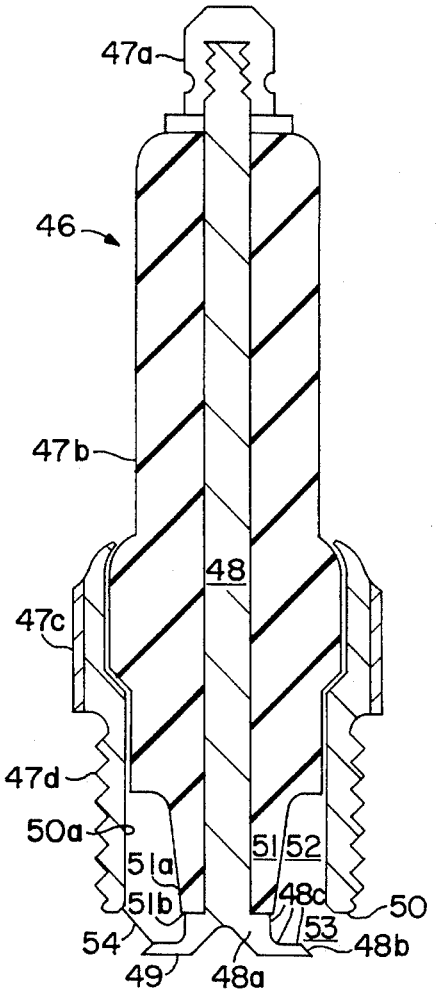
FIG. 11
FIG. 11d
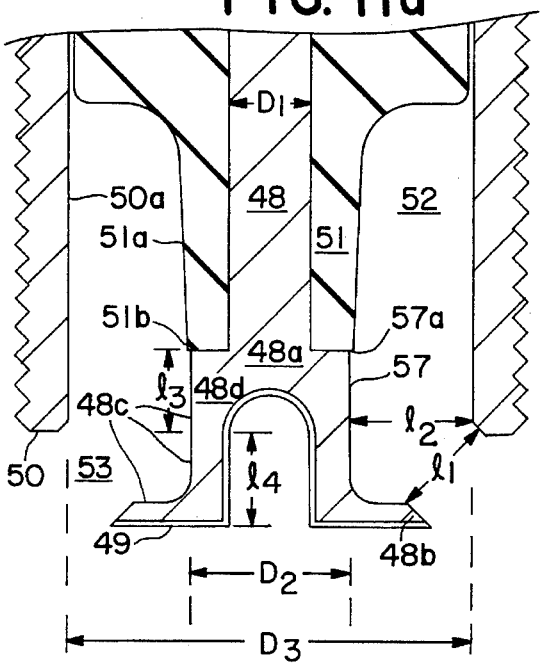
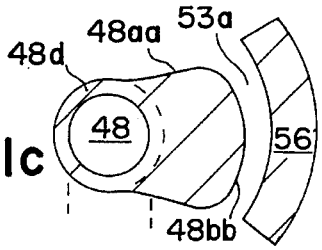
FIG. 11c
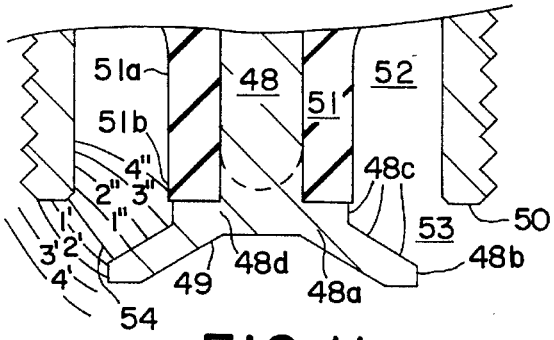
FIG. 11a
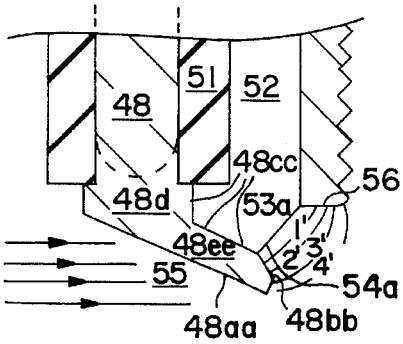
FIG. 11b

OPTIMIZED HIGH POWER HIGH ENERGY IGNITION SYSTEM

This application is a continuation-in-part of my patent application Ser. No. 8-066868, filed May 25, 1993.

BACKGROUND OF THE INVENTION AND PRIOR ART

The present invention relates to ignition systems for internal combustion engines, and particularly high power, high energy capacitive discharge ignition systems for multi cylinder engines. Such ignition is essential to the operation of high efficiency internal combustion engines using the more difficult to ignite dilute mixtures, such as lean mixtures, high residual or high EGR mixtures, and fuel-air mixtures of the more difficult to ignite fuels such as the alcohol fuels. Such high power, high energy ignition delivers power to the mixture at the rate of hundreds of watts versus tens of watts for conventional inductive ignition and conventional capacitive discharge ignition. Total useful energy delivery to the mixture ranges from about fifty millijoules to several hundred millijoules, versus five to twenty millijoules for conventional ignitions.

The ignition is usable in the simpler distributor form or in a distributorless ignition form preferably achieved by the use of a separate leakage inductor disclosed in U.S. patent application Ser. No. 7-350945, now abandoned and U.S. Pat. No. 5,131,376. The high power/high energy feature is attained by the use of the voltage doubling principle disclosed in U.S. Pat. No. 4,677,960 and its improvements. The ignition control system is based in part on U.S. Pat. Nos. 4,688,538 and 5,131,376. U.S. Pat. Nos. 4,774,914, 4,841,925, 4,868,730, and 5,207,208 may also be relevant to other features of the invention. The said application and all said patents are of common assignment with this application.

Reference to the above cited application and patents is sometimes made herein by simply listing the last three numerals of the number, as in patent application '945, and patent number '376, '960, '538, '914, '925, '730, and '208.

SUMMARY OF THE INVENTION

The present invention features capacitive discharge ignition system for multi cylinder engines including high power high efficiency DC to DC converter and control circuitry, high efficiency high power recharge circuit where applicable, distributor and distributorless ignition with bi-directional switches operated by steering control circuitry, resonating leakage inductor and compact coils, and overall control circuitry for the ignition system which is preferably operated as a gate controlled spark firing system in a multi-pulsing or oscillating mode of typical frequency in the range of 3 to 6 kilohertz (kHz), the higher frequency preferred at higher engine speeds and at high cylinder turbulence. During engine cold start, the spark duration is preferably longer for better combustion of the fuel mixture and lower hydrocarbon (HC) and carbon monoxide (CO) emissions.

The ignition discharge circuit components are designed according to an optimization criterion first disclosed in patent '960 and patent application '945 and expanded herein to specify an optimization of discharge circuit components. The basis is the solution of coupled differential equations for the circuit voltages which led to the transient voltage doubling formulation first disclosed in patent '960, and the solution of Maxwell's equations for the magnetic flux densities in the ignition coil core materials, first disclosed in application '945, using the patented voltage doubling solution as the open circuit high voltage source for generating the peak open circuit magnetic flux density.

A principal object of the present invention is the use of principles and features of the inventions cited above with certain new ideas and features disclosed herein to provide a more optimized, more versatile, and more effective ignition system for single and multi cylinder engines able to deliver high power, e.g. of order of magnitude of 100 watts, for a variable duration of sufficient time to deliver tens to hundreds of millijoules (mj) of total spark energy to the air-fuel mixture to insure the ignition of difficult to ignite mixtures.

At low engine speeds the energy is delivered in a more optimized pulsing time and speed modulated mode producing an ignition spark pulsing train of essentially constant amplitude pulsing at intervals of 250 to 500 microseconds (usecs) with an overall duration of about 2 to 20 milliseconds (msecs), the longer time occurring at very low engine speeds and at engine cold start and running. At high engine speeds, the energy is preferably delivered continuously or in a pulsing mode at time intervals of 150 to 300 usecs lasting for one to three msecs (for an assumed sinusoidal spark pulse duration of about 100 usecs duration).

The principles and features disclosed herein are used to produce a discharge circuit parts optimization in combination with the above mentioned more optimized ignition firing sequence. The energy is preferably delivered by a plug with a toroidal gap, as disclosed in the prior patents, allowing the spark pulses at low engine speeds to move around the plug tip periphery which is preferably made up of low erosion material such as tungsten-nickel-iron, platinum, etc. The plug tip is well heat-sunk and designed to minimize fouling by keeping the spark discharge away from the plug insulator, as disclosed.

Another object is to optimize and balance the ignition parts size and cost and the spark discharge size and spark plug erosion. A preferred embodiment is a hybrid arc/glow discharge circuit, powered by a boost converter with novel switching and control features, which produces an initial breakdown spark of high frequency and high current (for minimum coil core size and cost and intense initial spark), followed by a long duration lower frequency oscillating current of lower amplitude defining a high current glow discharge which can provide good quality ignition with a large spark gap of approximately 0.1" or greater while reducing spark plug erosion and plug insulator fouling.

Other features and objects of the invention will be apparent from the following detailed description of preferred embodiments taken in conjunction with the accompanying drawings.

BRIEF DESCRIPTION OF THE DRAWINGS

FIG. 11 is a side view of a preferred spark plug, and FIGS. 11*a* to 11*d* are fragmentary side views of alternative toroidal and partially toroidal gapped spark plugs designed to keep the spark discharges away from the insulator tip of the spark plug to minimize fouling of the insulator.

DESCRIPTION OF PREFERRED EMBODIMENTS

Figure 1A:
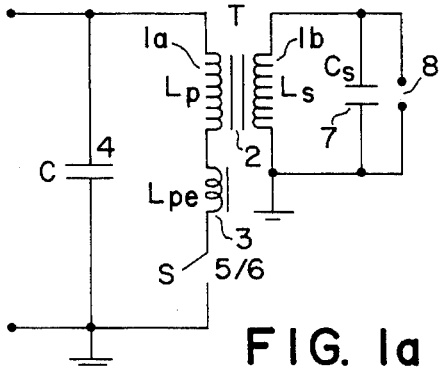
FIG. 1*a* is a circuit drawing of the basic capacitive discharge (CD) ignition circuit.

FIG. 1*a* is the basic CD ignition circuit comprised in part of an ignition coil transformer T made up of a primary winding 1*a*, a secondary winding 1*b*, a magnetic core 2, and a coil leakage inductance 3. The remainder of the circuit comprises an energy storage and discharge capacitor 4 (C), a two or three component switch 5/6 which, with the coil T primary winding 1*a*, comprises the primary circuit, and a secondary circuit output capacitance 7 (Cs) and spark gap 8 which comprises the secondary circuit with the coil T secondary winding 1*b*. The circuit operation is described in any of a number of the previous referenced patents. Briefly, the circuit operates when switch 5/6 is closed which results in the flow of open circuit high frequency current in the primary and secondary circuits which charges up the output capacitor 7 to a high voltage Vs (of typically 30 to 40 kilovolts (kV) maximum in the present application) which subsequently breaks down the spark gap 8. Following spark breakdown, the energy stored in the capacitor discharges and resonates with the leakage inductance 3 (Lpe) at a frequency determined by the particular application (10 kHz being a typical frequency value used).

One important feature of this circuit is that it is designed to make use of voltage doubling as disclosed in patent '960. In that patent was disclosed the high frequency open circuit solution (of the two coupled differential equations describing the primary and secondary circuits) which is reproduced below:

$$V2(t)=k*N*V1*[1-\cos(w2*t)]/[1+(N**2)*C2/C1] \quad (1)$$

where V2 (also designated as Vs) is the coil open circuit secondary voltage, k is the coil coupling coefficient, N is the turns ratio of the coil secondary turns Ns (or N2) to the primary turns Np (or N1), V1 (or Vp) is the primary voltage (initially essentially equal to the voltage Vc to which capacitor C is charged), w2 (or ws) is the open circuit angular frequency, and C2 and C1 are the secondary (Cs) and primary circuit capacitances (C or Cp) respectively.

The term "[(N**2)*C2/C1]" is defined as the doubling factor "DF" as per patent '960, and "1+DF" is defined as UF, the unity factor as per patent '960 and pate,it application '945, and is approximately equal to and greater than one, e.g. typically between 1.0 and 1.2 as per the voltage doubling criterion which is assumed as part of the present design criteria of the disclosure. The symbols "*", "**" designate multiplication and exponentiation. The term "approximately" as used herein means within plus or minus 25% of the value it refers to.

The open circuit angular frequency w2 is given by:

$$w2=SQRT\{UF/[Le*(N**2)*C2]\} \quad (1a)$$

$$UF=1+(N**2)*C2/C1=1+DF \quad (1b)$$

where "SQRT" designates the square root. Le is the total primary discharge circuit resonating inductance which includes the coil leakage inductance Lpe and any other inductances placed in the primary discharge circuit (such as Lea and Leb of FIG. 2), i.e.

$$Le=Lea+Leb+\ldots+Lpe;\ Lpe=Lp*(1-k**2) \quad (1c)$$

where Lp is the coil primary inductance.

Besides the open circuit voltage V2, the other important circuit parameter is the closed circuit (spark firing) primary current Ip (or I1) which is given by:

$$I1(t)=[V1/Z1]*\sin(w1*t) \quad (2)$$

$$Z1=SQRT[Le/C1];\ w1=1/SQRT[Le*C1] \quad (2a)$$

where Z1 and w1 is the primary circuit impedance and angular frequency.

Figure 1B:
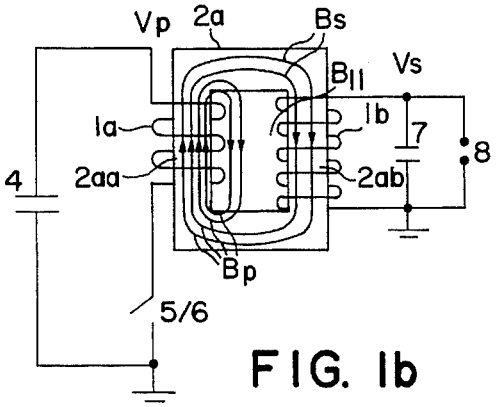
FIG. 1*b* is a drawing of the basic CD circuit with a side-view of the coil with its two windings and magnetic core supporting the magnetic flux linking the two windings.
Figure 4:
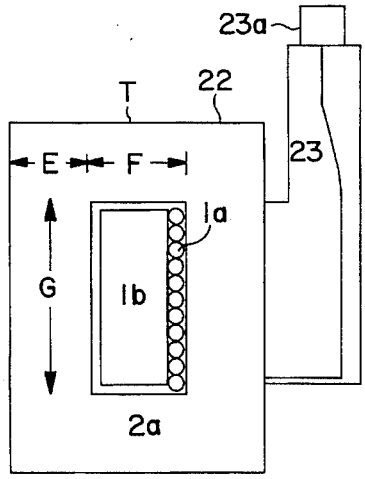
FIG. 4 is a side view of a preferred U-core (or C-core) for the compact coils of the distributorless ignition.

Other design parameters are the open and closed circuit magnetic flux densities in the core of the coil T. The flux density lines are shown in the drawing of FIG. 1*b*, where the core 2 (shown by electronic symbol in FIG. 1*a*) is shown in side view as a C/U core in FIG. 1*b*. The primary and secondary windings 1*a* and 1*b* are shown wound on opposite legs 2aa and 2ab of the core 2a (the high leakage winding) for convenience, although more typically the turns are wound concentrically (the low leakage winding) as shown in FIG. 4.

In FIG. 1b like numerals depict like parts with respect to FIG. 1a. The main point of the figure is to show the three sets of magnetic flux lines Bp, Ble, and Bs produced by turning on switch 5/6 and setting up primary current Ip (or I1) in the primary winding 1a, where Bp (or B1) designates the flux lines produced by the primary winding 1a, Bs (or B2) designates flux lines coupled to the secondary winding 1b, and Ble designates the flux lines leaked past the secondary winding 1b.

Following the procedure of patent application '945, we take the integral form of one of Maxwell's equation, i.e. Faraday's law, and spatially integrate it around a core cross-section of area Ai around which a winding of turns Ni is wound with a voltage Vi across the winding, to obtain for the magnetic flux Bi:

$$Bi'(t)=Vi(t)/(A*N)$$

where the prime symbol "'" means differentiation with respect to time.

Applying this to the secondary winding around core 2ab of FIG. 1b:

$$B2'(t)=V2(t)/A*N2$$

which is integrated (in time) after substituting for V2 (equation 1) to give:

$$B2(x)=[k/UF]*[V1/(*pi*f2*N1*A)]*[x-\sin(x)] \quad (3)$$

$$x=w2*t, \text{ the open circuit (High voltage) phase angle} \quad (3a)$$

where "pi" equals 3.142, f2=w2/(2*pi) is the open circuit frequency, and A is the core cross-section around which the secondary winding is wound. Note that f2 and f1 (where f1=w1/(2*pi)) are related according to:

$$f2=f1*SQRT(UF/DF) \quad (3b)$$

which for UF preferably typically equal to 1.1 (DF=0.1) makes f2 approximately three times the frequency of f1.

The short circuit (spark firing) primary winding magnetic flux density is:

$$B1'(y)=V1(y)/A*N1;\ V1(y)=[Vc/(A*N1)]*\cos(y)$$

$$B1(y)=[Vc/(2*pi*f1*A*N1)]*\sin(y) \quad (4)$$

$$y=w1*t, \text{ the short circuit (spark firing) phase angle} \quad (4a)$$

Design of the ignition system requires specification of the independent parameters, specification of the governing equations, and specification of phase angles x(t0) and y(t1) from which specification of key dependent parameters (as per the governing equations) can be made. The independent parameters, i.e. the "initial design parameters", are Vc, Le, C1, and hence f1, followed by A and N1. From these DF and UF are evaluated. The phase angles x(0) and y(1) must then be specified, from which V2(0), B2(0), and B1(0) can then be evaluated. The specification of y(t1) is straightforward since it undergoes complete (spark firing) oscillations with maxima of Ip and B 1 occurring every half cycle:

$$y(1)=w1*t(1)=90 \text{ degrees}$$

$$B1(0)=Vc/(*pi*f1*A*N1) \quad (5)$$

which is the maximum magnetic flux density in the leakage inductor core(s) in the primary discharge circuit.

Equations (1) and (3) can be simplified to give:

$$V2(x)=k*V1*(N/UF)*[1-\cos(x)]$$

$$B2(x)=k*B10*SQRT\{DF/[(UF)**3]\}*\{x-\sin(x)\}$$

The design specification for x(t0) is not clear as discussed in patent application '945. It is selected here, as a best trade-off value, to be 155 degrees, i.e.

$$x=155 \text{ degrees} \quad (6)$$

which gives for V2 and B2 the "peak design values" of:

$$V2(0)=.9*k*V1*(N/UF) \quad (7)$$

$$B2(0)=.25*k*B1(0)*SQRT\{DF/[(UF)**3)]\} \quad (8)$$

recalling that B1(0) is inversely proportional to the frequency f1, so that the higher f1 is, the lower is B1(0) and B2(0) (also designated as B10 and B20).

The coupling coefficient k, in general, includes in addition to the coil leakage inductance Lpe, other inductances, i.e. resonating inductances, in the primary circuit discharge path comprising a total inductance of Le:

$$k=SQRT\{1-(Le/Lp)] \quad (9)$$

Equations (1) through (9), and especially equations (5) through (9) define the system of equations from which an optimization of the ignition is carried out in terms of the minimum coil core sizes, the maximum output voltage V2(0), and the best trade-off in ignition spark firing power, total spark energy delivery, and circuit efficiency. Usefulness of the optimization procedure is revealed by examples carried out with reference to some of the following drawings.

Figure 2:
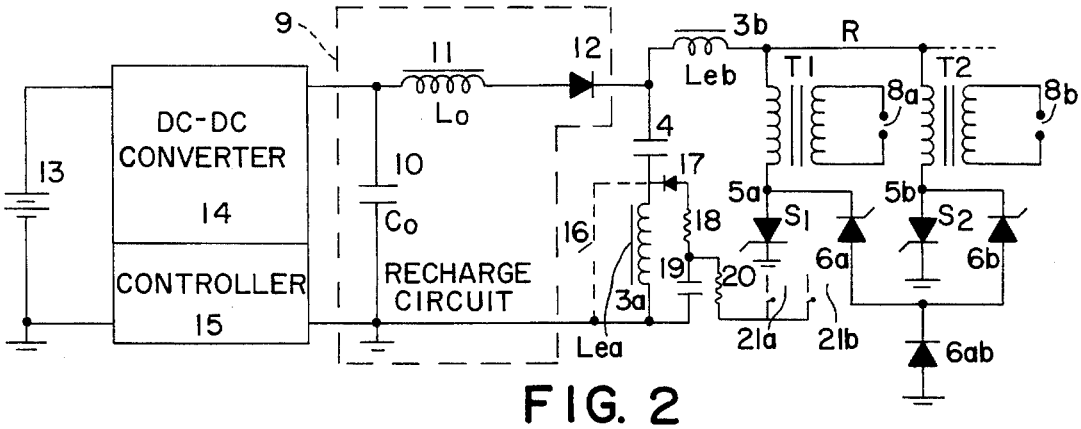
FIG. 2 is a circuit diagram, partially block diagram and partially detailed circuitry of an embodiment of the entire ignition system.

FIG. 2 is a circuit block diagram of the distributorless ignition system depicting two of an arbitrary number of compact coils T1, T2 with bi-directional switches S1 (5a/6a/6ab) and S2 (5b/6b/6ab). Like numerals depict like parts with respect to FIGS. 1a and 1b. The main elements of the ignition are the battery 13, the DC-DC converter 14, the controller 15, and the recharge circuit comprising capacitor 10, inductor 11, and diode 12. The discharge circuit comprises capacitor 4, resonating inductors 3a and 3b (of typical total inductance Le of approximately 50 uH for 5 uF capacitance C1 of (400 volt) capacitor 4), and in-parallel compact coils T1, T2, . . . , with switches S1, S2, . . . , as disclosed in patent '376. High voltage diode 17, resistor 18 (of value about 1 kohm), capacitor 19 (of value about 0.1 uF) and resistor 20 (of value about 150 ohms) comprise speed-up-turn-off circuit as disclosed in patents '925 and '376. Switches 21a, 21b , . . . , are included in this preferred embodiment to steer the negative fast turn-off signals to the appropriate trigger of the SCRs 5a, 5b, . . . The term "about" as used herein means from ½ below to twice above the value it qualifies. The term "equal to" generally means within conventional tolerances, i.e. plus or minus 5%, or plus or minus 10%.

In operation, when switch Si is triggered (turned-on) it conducts sinewave current of approximately 100 usec period and amplitude of approximately 100 amps (and secondary spark current of approximately 2 amps for N=50), for the values selected for capacitor 4 of capacitance C, inductance Le, and input voltage Vc of 350 volts.

Also shown in the drawing is an optional shunting switch 16 disclosed in patent '376 which is used to create a higher frequency on the initial open circuit spark firing to allow for smaller sizes of coil Ti cores. In this embodiment main resonating inductance Lea (3*a*) is shunted during the initial spark firing, i.e. for the first half cycle of the first spark pulse which breaks down the spark gap, designated as the "spark breakdown", presenting an inductance equal to Leb (3*b*) plus the coil Ti leakage inductance Lpe. This gives a higher frequency f11 of:

$$f11=1/[2*pi*SQRT(Le*C1)] \quad (10)$$

where Le=Leb+Lpe versus Le=Lea+Leb+Lpe, and hence lower B10 and B20.

A disadvantage of this method of shunting primary circuit resonating inductance to raise the frequency f1, and hence f2, and hence to lower B20 and the coil core size, is that the peak primary current will be correspondingly increased due to the lower impedance Z1 as per equation 2*a*. An alternative method of accomplishing this is shown in FIG. 3.

Figure 3:
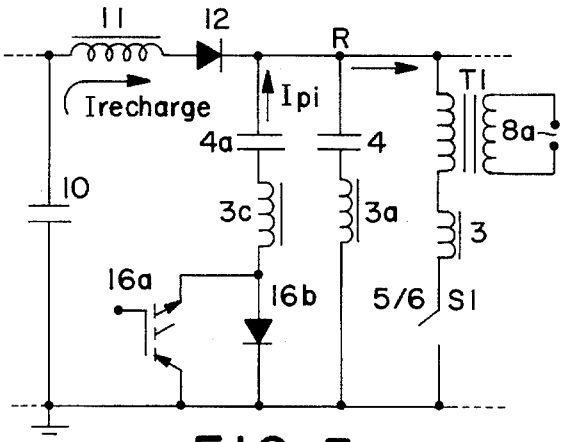
FIG. 3 is a circuit drawing of an alternative method of providing a high frequency for the open circuit initial high voltage breakdown spark for minimizing the size of the coils of distributorless versions of the ignition.

In FIG. 3 like numerals correspond to like parts with respect to the earlier figures. In this preferred embodiment is added, in series from the high voltage rail R to ground, a smaller capacitor 4*a* (C11) of approximately half the capacitance of the discharge capacitor 4, an inductor 3*c* of inductance Le1 of approximately half or less the main resonating inductance Lea (3*a*), and a switch 16*a*/16*b*, which comprise a "high frequency auxiliary circuit" in parallel with the discharge capacitor 4 and main resonating inductance 3*a*. Switch 16*a*/16*b* is shown to comprise a high voltage insulated gate bipolar transistor (IGBT) switch 16*a* with a shunt diode 16*b* with its cathode to ground.

In operation, when switch 5/6 of a coil T (T1 shown) is first activated, shunt switch 16*a* is turned on, and primary current Ipi begins to flow at a higher frequency f11 and more rapid rate (than main discharge current Ip) given by:

$$f11=1/[2*pi*SQRT(Le11*C11)] \quad (11)$$

$$Le11=Le1+Lpe \quad (11a)$$

For a preferred set of values of main discharge parameters disclosed, i.e. peak primary current Ip of approximately 100 amps and discharge frequency f1 of 10 kHz, the shunted "spark breakdown" peak current Ipi is also approximately 100 amps but the frequency f11 is twice f1, i.e. f11=20 kHz (for the case where C11 and Le1 are approximately half of C1 and Le respectively). The peak current of Ipi of 100 amps is more easily handled with a switch. As per patent '376 such switch 16*a* shunting discharge capacitor 4 is turned off after the first half discharge cycle and kept off for the remaining of the spark firing period (of typically multiple spark pulses resulting from multiple switch S1 turn-on forming a closed circuit for the discharge capacitor 4 and main inductor 3*a*).

FIG. 4 shows a preferred coil Ti (22) with high voltage tower 23 and high voltage tip 23*a*. For the primary winding 1*a* a single layer of preferably Litz wire is shown (twelve turns, Np, shown for the preferred voltage operation of 400 volts) and multiple layers, preferably eight to fourteen layers, of secondary winding 1*b* fill the remainder of the winding window of dimensions G by F of the core 2*a*. Preferably the winding length G is approximately 1½ inches and the winding width F is approximately ⅝ inches. Two layers of rectangular wire (of dimensions approximately 0.032" by approximately 0.16") may also be used in place of the single layer primary 1*a*. The turns ratio N, i.e. Ns/Np, is approximately 60.

For the present application, using resonating inductors, the core cross-section (E dimension shown) is determined by the peak open circuit magnetic flux density B20. The dimensions depend on the saturation flux density of the core material and the open circuit frequency f2 (which depends on f1 and f11). Specification of core dimensions are disclosed in patent '376 among others. Three cases are of particular interest in the present case: use of Metglas without and with shunting of inductance (or equivalently the use of the "high frequency auxiliary circuit" as per FIG. 3), and use of ferrite core with the auxiliary circuit.

For the case of Metglas with saturation flux density Bsat of 1.5 Tesla, a square core of dimensions ⅝"*⅝" is suitable for the case with no shunting of the inductance. That is, for Vc=360 volts, f1=10 kHz, DF=0.1 and hence f2=33 klH, k=0.99, Np=12, and x=155 degrees, then for an actual core area A of 0.4 square inches, i.e. effective core area A' of 0.3 square inches (the core factor K being 0.75), then B2 equals 1.5 TeSla, or equal to Bsat for the material. By using the high frequency auxiliary circuit with f11=20 kHz, then the core area A can be halved, or the core side dimensions reduced to ½" along with a reduced primary turns Np=10. The peak output voltage V2(0), or V20, in these cases is 36 kilovolts for N=58.

For the case of ferrite core material (Bsat=0.44 Tesla), to accommodate a preferred round core of diameter ¾" one needs to use the high frequency auxiliary circuit with f11=20 kHz and Np=14. Values of C1 of 3 uF and Le1 of 24 uH (or Leb=24 uH) would give a frequency f11 of 20 kHz (noting that Lpe is typically just a few uH, e.g. two to four uH). Obviously, the core size can be further reduced by increasing f11 (reducing the unshunted resonating inductance Leb or Le1) anti/or reducing DF (reducing N or the output capacitance C2). In the above cases of Metglas and ferrite the primary inductance is high, approximately 1 millihenry (mH) for Np approximately 12 and core area A approximately 0.4 inches square, giving a value of coupling coefficient k close to unity as per equation (9). For ferrites, "effective" and "actual" core areas are equal.

Figure 5A:
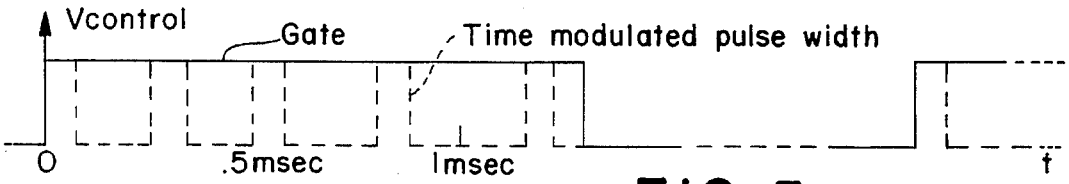
FIGS. 5*a*, 5*b*, 5*c* are respectively the control spark pulse firing waveforms made up of the gate and oscillator voltage, the spark current pulse discharges, and the recharge currents of a preferred embodiment of the ignition operated in a spark pulsing mode with modulation.
Figure 5B:
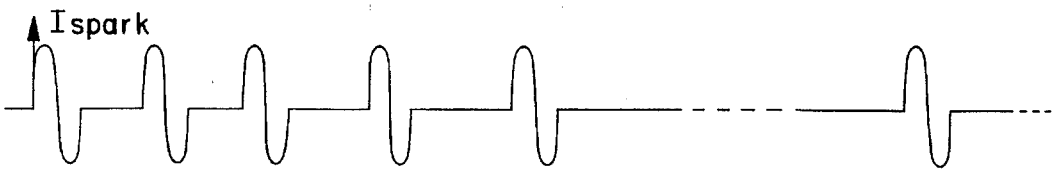
Figure 5C:
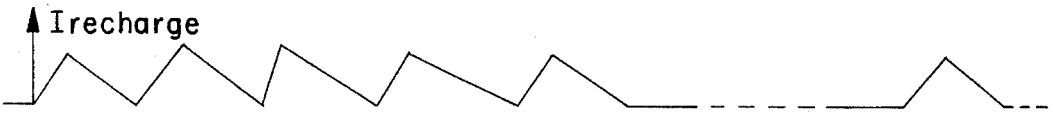

FIGS. 5*a* to 5*c* depict typical ignition spark pulsing waveforms of the preferred multi-pulsing mode with a time modulated pulse width for the spark pulses. FIG. 5*a* depicts the gate control voltage which defines the total spark pulsing width (typically 20% duty cycle, or 20% gate-time to total time between ignition firings) and the signals (broken curves) that are applied to switches S1, S2, . . . , to fire the spark pulses. FIG. 5*b* depicts the typical spark discharge current Ispark (or Is), and FIG. 5*c* depicts the recharge current (as per FIG. 3).

In a preferred embodiment it is desired to introduce spark pulsing modulation with speed (in addition to the time duration modulation shown in FIGS. 5*a* to 5*c*). This is shown with reference to FIGS. 6*a* to 6*c* which represent the gate and pulse control voltages (Vcontrol) for the low, medium, and high engine speed cases respectively. The gate width is reduced to maintain the approximately constant duty cycle with speed. In this preferred embodiment the total energy delivered per spark firing train reduces by a lesser amount with engine speed. Also, during the first tens of seconds up to a few minutes after starting a very long, e.g. two to three times the normal, spark firing gate duty cycle is preferred to help reduce engine hydrocarbon (HC) and carbon monoxide (CO) emissions. In this case of very long spark firing duration the low speed modulation is more practical. For the low speed case the time between pulses is initially approximately ¼ msec and increases to approximately ½ msec (as per FIG. 6*a*), and in the other extreme, the high speed case, the time between pulses ranges between approximately 150 and 300 usec, where time between pulses includes the spark firing time of typically approximately 100 usecs (except for the first pulse which may be shorter due to shunting of the inductor).

Figure 6A:
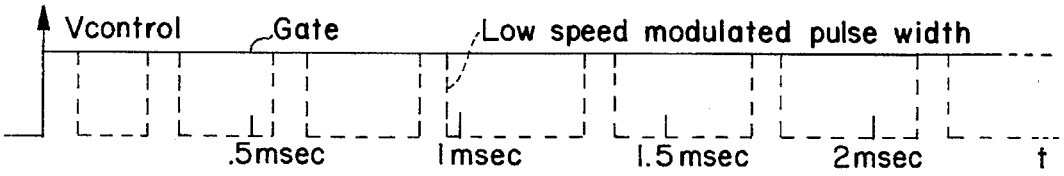
FIGS. 6*a*, 6*b*, 6*c* are the gate controlled spark firing waveforms made up of the gate and oscillator voltage for low, medium, and high engine speeds respectively where modulation with engine speed of the spark pulsing period is used in addition to time modulation as shown and described in FIG. 5*a*.
Figure 6B:
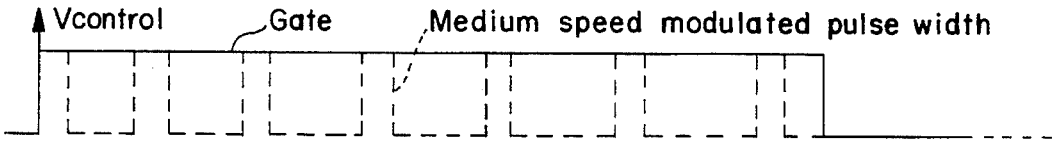
Figure 6C:
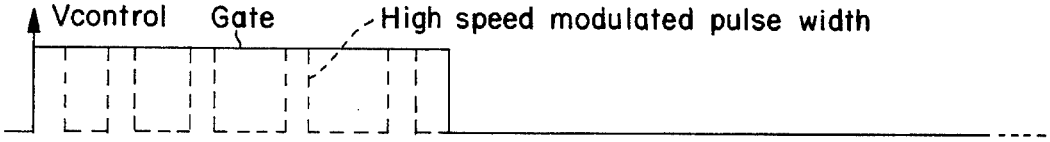
Figure 7:
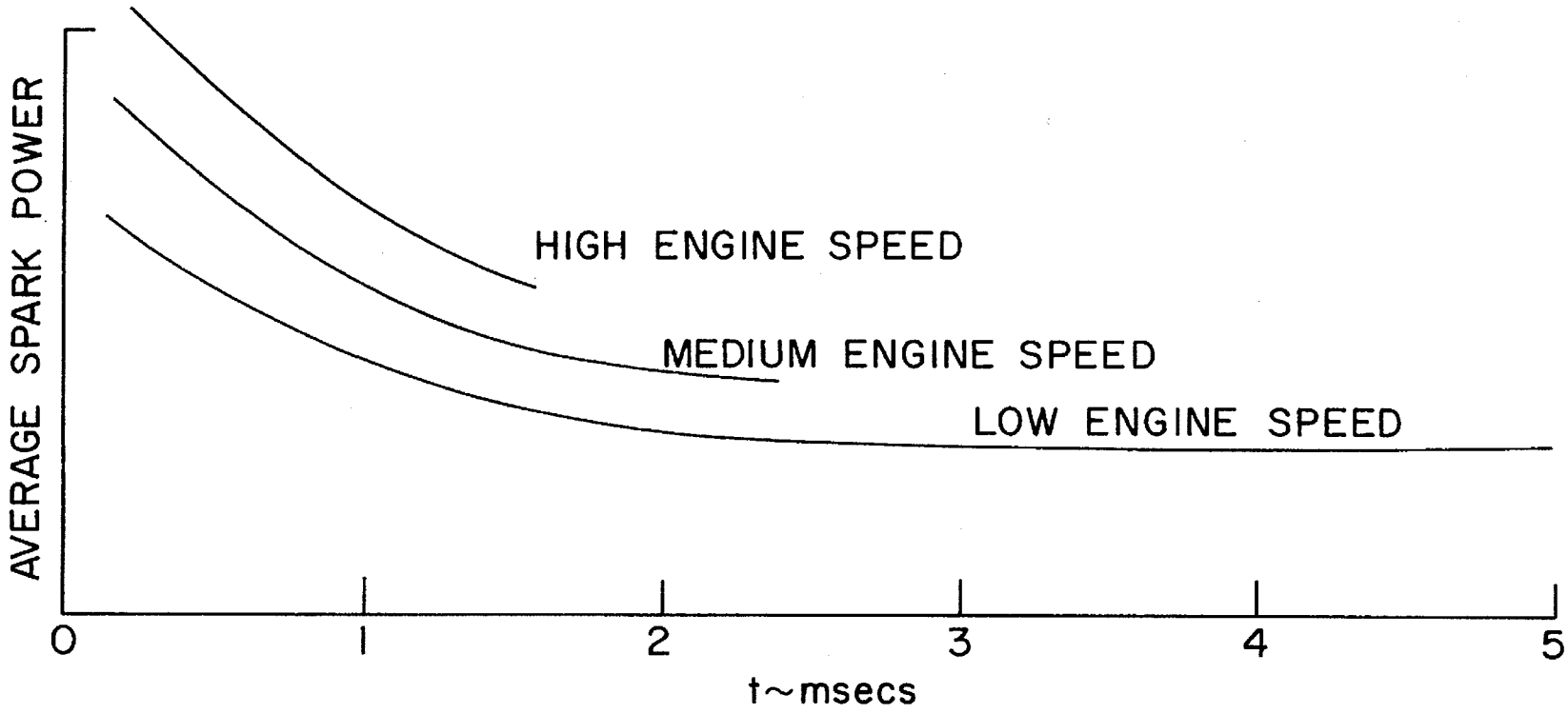
FIG. 7 is a plot of average spark power versus time for the three cases of FIGS. 6*a* to 6*c* for low, medium, and high engine speeds.

FIG. 7 depicts plots of three curves of the average spark power delivered by the ignition system operating in the pulsing mode as per FIGS. 6*a* to 6*c*.

Figure 8A:
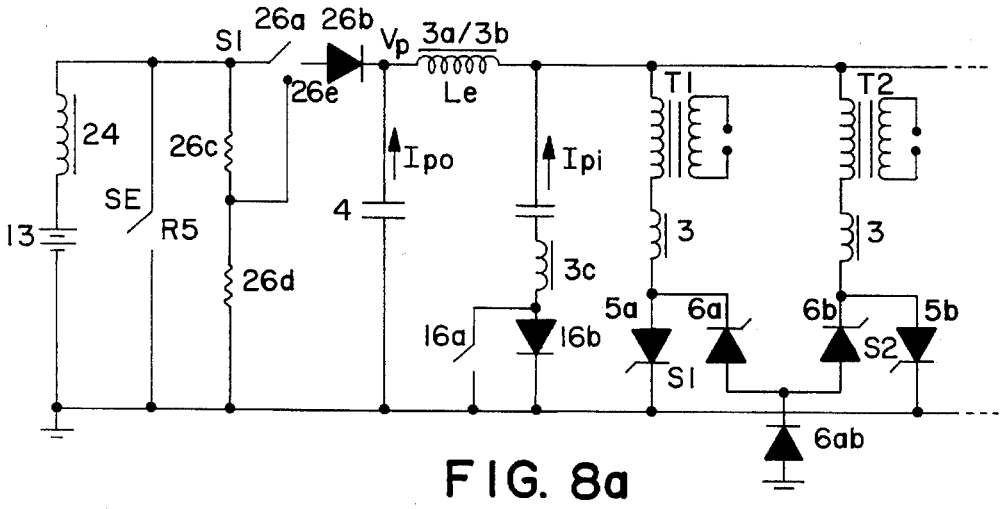
FIG. 8*a* is a drawing of a compact and simple ignition circuit using a boost converter with the ignition discharge capacitor as its load and further designed to produce a high frequency open circuit initial high voltage spark breakdown with high initial spark current followed by a long duration lower current (low arc current but very high glow discharge current) spark discharge.

FIG. 8*a* depicts an ignition circuit in which the main discharge circuit, made up of capacitor 4 and resonating inductor 3*a*/3*b*, is used without a recharge circuit, and capacitor 4 is also used directly as the load for the power converter, which is shown to be a boost converter, comprised of an energy storage inductor 24, an energy switch 25, and diode 26*b* and an isolating switch 26*a* which is triggerable from the voltage node 26*e* of resistor divider 26*c*, 26*d*. For producing the initial high frequency breakdown spark is shown the high frequency auxiliary circuit. Like numerals correspond to like parts with respect to the earlier figures.

This ignition is of particular interest in that it is relatively simple yet includes some of the key features disclosed herein and in the referenced patents and patent applications. The high frequency initial spark pulse insures minimum size of the core of the ignition coil Ti, and the main discharge circuit allows for a wide range of operation, from the pulsing operation already disclosed, to a continuously firing "ringing" operation with either the typical spark (arc) current of about two amps, or lower high glow discharge currents of about 500 ma, i.e. 250 ma to 1000 ma. Isolating switch 26*a* is included to insure that the second half of the primary circuit discharge sinewave currents return via the coil switches Si and not through battery 13.

Figure 8B:
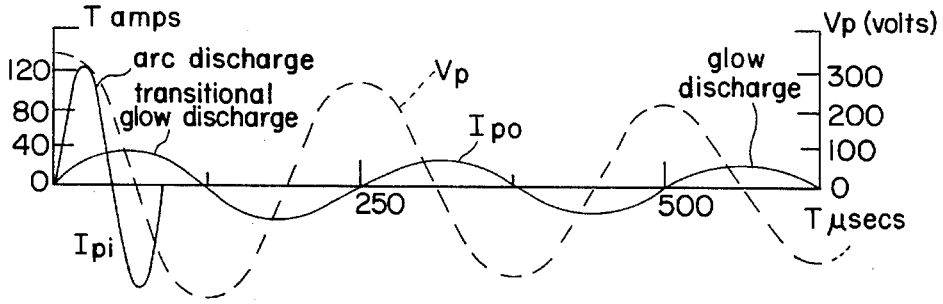
FIG. 8*b* depicts plots of the primary voltage waveform and the initial high frequency primary circuit currents Ipi and the follow-on lower frequency current Ipo of the circuit of FIG. 8*a*.

A preferred embodiment is one in which the main discharge circuit is fired continuously for several oscillations instead of in the pulsed mode. FIG. 8*b* depicts the resulting primary current from such an operation, where the initial auxiliary circuit high frequency current Ipi has a peak value of approximately 120 amps and a frequency of approximately 12 kHz, and main discharge current Ipo is of lower frequency of approximately 4 kHz, and of lower amplitude of 40 amps peak and dropping. For a turns ratio N of 60, this results in a initial main discharge spark current of 700 ma, representing the borderline between an arc discharge and a (transitional) glow discharge.

Use of the (high current) glow discharge can be advantageous in reducing the spark plug erosion and plug fouling, i.e. in the glow discharge the ionization is maintained by a high voltage of approximately 300 volts at the cathode, versus by a high temperature cathode spot (in the case of the are discharge). By use of high current glow discharge of about 500 ma, designated as the "transitional glow discharge", and by firing the ignition continuously for several oscillations ("ringing" the spark), the same average power can be attained as the multi-pulsed are discharge of ⅓ duty cycle (as per the low speed curve of FIG. 7) for a high total energy delivery to the mixture of tens to hundreds of millijoules (mj).

The use of the auxiliary circuit has the advantage that the main resonating inductor 3*a*/3*b* (Le) can be conveniently located outside the current path of the boost converter charging of capacitor 4 as shown.

For purposes of clarification, a complete engine cylinder spark plug ignition firing shall be referred to as an ignition firing, a spark firing, or a spark pulse firing train, and an individual pulse which is pan of a complete spark firing shall be referred to as a spark pulse or spark oscillation.

In a 400 volt application, a preferred embodiment is one with capacitor 4 having capacitance C1 of approximately 5 uF and inductor 3*a* an inductance Le of approximately 200 uH for a spark discharge frequency of approximately 5 kHz. The turns ratio N is preferably approximately 60. Design of the ignition coils Ti are as previously disclosed and are governed by the high frequency (HF) initial breakdown condition, and not by the main discharge condition.

The available open circuit voltage following the initial HF discharge is lower since the open circuit frequency is lowered by the larger main resonating inductor Le, and the coil core will saturate at a lower magnetic flux density under subsequent open circuit or quasi-open circuit conditions, thus substantially reducing the subsequent available open circuit output voltages. This is not a problem in the ringing mode operation since the voltages needed to restrike the spark following current zeros is a small fraction of the initial peak voltage of approximately 36 kV, except for engines with very high air-flow and turbulence. In such cases operation at the higher frequency end of the "low frequency range", e.g. 6 kHz, with consequent higher spark current of about 1 amp may be required, or the higher frequency embodiments of FIGS. 2 and 3 may be needed.

The initial high frequency discharge of FIG. 8*a* was achieved via the use of the auxiliary circuit. The lower main discharge frequency of approximately 5 kHz makes the option of shunting of the resonating inductor (3*a*) with an SCR practical (switch 16 of FIG. 2) since the SCR has ample time to recover.

Figure 8C:
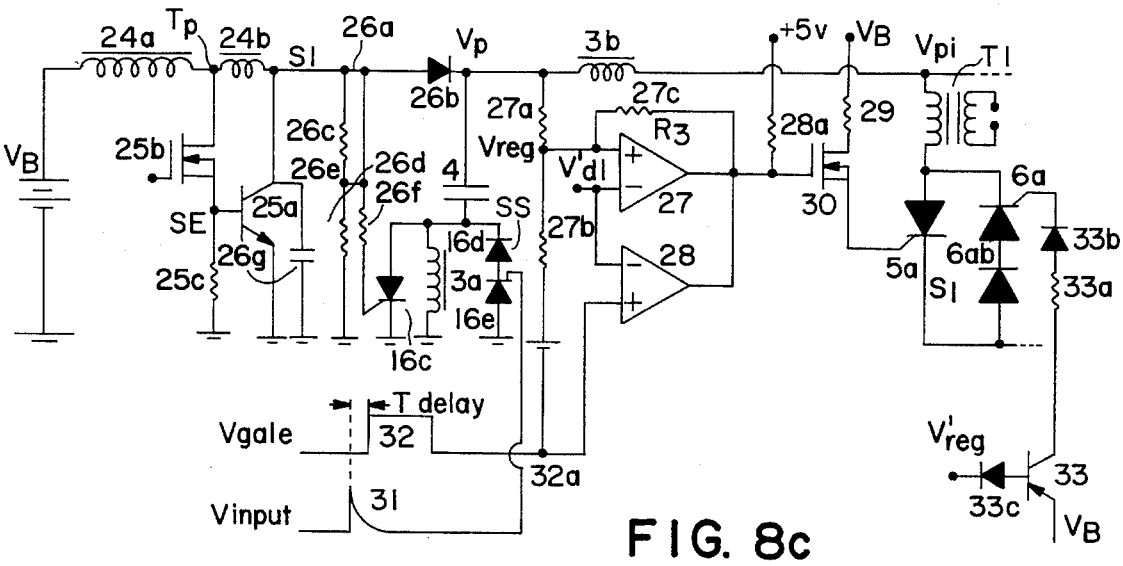
FIG. 8*c* is a more detailed partial drawing of a variant of the circuit of FIG. 8*a* employing a shunt switch SS instead of a high frequency auxiliary circuit and including details of preferred embodiments of the energy boosting switch SE, and further depicting a simple form of ignition controller for the "ringing" type ignition firing.

In FIG. 8*c* is shown, among other features, such shunting of part of the resonating inductor Le (3*a*) (SCR 16*c* is included to shunt inductor 3*a* during capacitor charging by switch SI). The shunt switch SS is made up of a series diode 16*d* and SCR 16*e*, triggerable by input trigger 31. The unshunted inductor 3*b* defines the high frequency operation. Like numerals correspond to like parts with respect to the earlier figures. In this embodiment, the preferred operation of approximately 5 to 6 kHz of the main discharge frequency gives SCR 16*e* its needed one quarter period, approximately 40 to 50 usecs to recover following its forward discharge of very high peak current. This peak may be up to approximately 200 amps given the very low duty cycle of about 1% or less. This makes for a particularly simple, practical, yet powerful ignition system.

Other features of the system are disclosed, including some details of the power converter and of a preferred simple ignition controller for the ringing type spark. For the boost converter a proportional drive is shown where the energy storage inductor Lb (24 of FIG. 8*a*) has a tap which divides the inductor into two parts, the main inductor 24*a* and tapped inductor 24*b* (or a separate inductor 24*b* may be used). For the energy switch SE (25, FIG. 8*a*) is shown the main switch 25*a* (an NPN bipolar transistor) and the driver field effect transistor (FET) switch 25*b* with its drain to the tapped point Tp and its source supplying current to the transistor switch 25*a* base, which is tied to ground through resistor 25*c*. The boost converter operates by turning energy switch SE on and off to repetitively store energy in inductor Lb and then deliver it at a high voltage to capacitor 4. In a low frequency (lower switching losses) operation of say 10 kHz frequency, the switch SE on-time may be 95 usec and the typical off-time may be 5 usec, and for a triangular distribution peak current Ib of 15 amps and battery voltage Vb of 14 volts gives an average power Pdel:

$$Pdel=\tfrac{1}{2}*Vb*Ib=100 \text{ watts}$$

assuming no losses, and 85 watts assuming an achievable 85% efficiency.

For the inductor Lb for the 10 kHz application, one could employ a standard ETD-44 ferrite core with a standard core gap of 0.085" (A1 of 160 mH per 1000 turns) for an inductance of 100 uH for turns N1 of 25. The inductor can be conveniently wound on the bobbin with three layers of Litz wire of 9,8,8 turns per layer with a tap on the top layer for FET 25b (of low RDS of about 0.5 ohms). The FET is driven by the controller 15 which may be a 555 timer as per FIG. 9 operating as a controlled oscillator whose ON-time and OFF-time may be modulated by the input and output voltages of the power converter. Inductor 24b is preferably approximately 20% of the total inductance Lb to supply approximately 20% drive (base) current to main transistor 25a.

In a preferred embodiment, isolation switch 26a is automatically turned on when energy switch SE turns off and its collector voltage rises to provide, say at a threshold voltage of 30 volts, a trigger to turn on isolation switch 26a and shunt SCR 16c (via resistor 26f) and allow the energy stored in the inductor 24a/24b to be delivered to capacitor 4. Note that a time delay, Tdelay, of about 50 usecs between the ignition firing input trigger 31 and the gate signal 32 is introduced to give SCR 16c time to recover before the ignition system is fired (energy switch SE will typically be tubed off on ignition firing followed by isolation switch SI being turned off within a number of microseconds dictated by the time required for inductor 24 to deliver its current).

For the ignition controller is shown a design based on: 1) creation of a constant gate signal Vgate (32) from the ignition trigger signal 31, representing the maximum (idle speed) firing time, and 2) definition of a "low" or minimum threshold discharge voltage Vdl below which the ignition firing is terminated. This obviates the need for a variable ignition firing gate, although a variable gate can be advantageously used.

Typically, Vgate is about 3 msec duration and Vdl approximately ¼ to ½ the peak discharge voltage Vc (representing energy delivery approximately 80% of the stored energy). The primary voltage Vp is sampled via the regulator divider made up of resistors 27a (RI) and 27b (R2), and the divided voltage Vreg is fed to the non-inverting input of a comparator 27 (with hysteresis resistor 27c), and the appropriately scaled down "low" reference voltage Vdl' is fed to the inverting input of the comparator. The output is connected to the gate of an FET 30 (or base of a transistor) which is tied to a voltage source (battery) through a resistor 28a. Likewise, V gate is connected to a comparator 28 with its inverting input connected to a reference voltage (Vdl' taken for convenience) and its output connected to the output of comparator 27. In this way, when both the gate voltage is high (enabling the ignition to fire) and the discharge voltage is above the minimum threshold, then the ignition is triggered, i.e. FET 30 triggers SCR 5a, and the ignition fires. Firing continues until either the gate voltage drops (maximum firing time) or the peak primary voltage drops below Vdl (maximum energy delivery), for continuously firing ignition as per FIG. 8b.

For a distributorless ignition the return SCR 6a is fired by means of a PNP transistor 33 connected to the trigger of SCR 6a from its collector through resistor 33a and high voltage diode 33b. The transistor emitter is connected to a voltage source and the base, via a diode 33c, to either a regulation point Vreg' or to the high primary voltage point Vp via a large resistor. Voltage Vp is negative when return SCR 6a needs to be fired.

Hysteresis resistor 27c insures that once the ignition is turned off because the required energy has been delivered (the time duration being less than the gate time Tgate) then the ignition won't turn on again until a new gate signal is received (assuming the power supply does not charge capacitor C1 rapidly, which would be the case for a moderate 100 watt power supply). Alternatively, the hysteresis can be used to produce multi-pulsing of the ignition.

With reference to voltage Vp in FIG. 8b, it is noted that the power converter can be operated for a 50% duty cycle when the ignition is firing, i.e. voltage Vp is greater than zero for half a spark pulse oscillation. This helps add more energy to the discharge capacitor 4 and more energy to the ignition spark. But this is only practical at very high power converter frequencies, e.g. 50 kHz.

Figure 9:
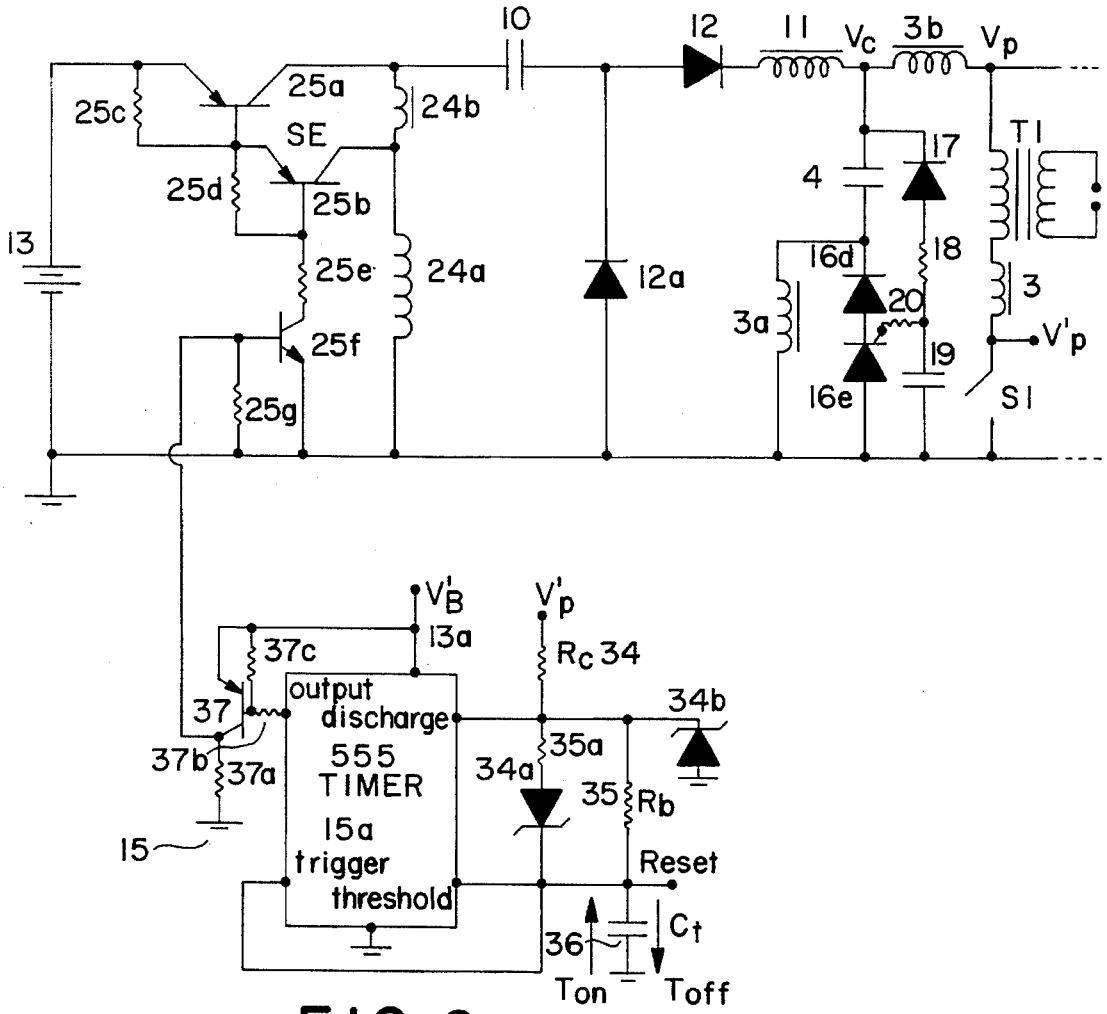
FIG. 9 is a variant form of the circuit of FIG. 8*c* with a different topology of boost converter and including a preferred controller for the boost power converter.

FIG. 9 is an ignition circuit depicting a preferred controller 15 for the boost converter and an alternative topology boost converter that does not require an isolation switch SI. Like numerals correspond to like parts with respect to FIGS. 8a and 8c. In this embodiment the main energy switch SE is connected in series with the battery 13 and the output load recharge capacitor 10 to automatically provide isolation, and a proportional drive is provided for the switch SE, as in FIG. 8c, made up of a main inductor 24a and a tapped inductor 24b, which in this case are connected between the output of the main switch and ground. Diode 12a completes the path for delivering the power converter energy to the load 10. The energy switch is preferably comprised of the main switch 25a and drive switch 25b, both PNP transistors, with base to emitter resistors 25c and 25d respectively, and a control NPN transistor 25f which pulls the base of drive transistor 25b to ground through resistor 25e for turn-on. Resistor 25g is the base emitter resistor for the control transistor whose emitter is grounded. Control transistor 25f is turned on and off by the controller 15. Inductors 24a and 24b are part of the recharge inductor 11 in this topology. The smaller tapped inductor section 24b is connected between the collectors of the main switch 25a and drive switch 25b to provide the required proportional drive.

Controller 15 is based on a "555 Timer" 15a operated in a controlled astable mode except that the circuit is designed to have the normally high output of the Timer (15a) correspond to the off-time (Toff) versus the usual on-time (Ton), where the "on" and "off" times correspond to the times that main boost converter switching transistor SE is on and off. In this way, the off-time, which is inversely proportional to the output voltages Vp' (or Vc or Vp), can be modulated by the output voltage, providing some significant advantages.

As shown, Voltage node Vp' is connected through a timing (charging) resistor 34 of value Rc kohms, through a shunting (zener) diode 34a (shunting the other timing (discharge) resistor 35 of resistance Rb), to the timing capacitor 36 of capacitance Ct. The low voltage end of charging resistor Rc is connected to one end of the discharge resistor Rb and to the "Discharge" node of the 555 Timer as shown. The other end of discharge resistor Rb, connected to the cathode of the shunting diode 34a and capacitor 36, is connected to the "Threshold" node of the Timer as shown.

In operation, capacitor Ct is charged by voltage Vp' through resistor Rc, representing the off-time Toff as shown by the downwards arrow, raising the capacitor voltage from ⅓*VB' to ⅔*VB'. VB' is the switched and filtered battery voltage supplying the 555 Timer. The timer then resets, and capacitor Ct discharges (on-time Ton, upwards arrow) through resistor Rb to ⅓*VB'.

For the booster converter operation, the "on" and "off" times are related by:

$$Toff=(VB/Vp')*Ton$$

One can show that based on the Timer circuit shown:

$$Ton=(⅔)*Rb*Ct$$

$$Toff=(⅔)*Rc*Ct*[(½)*VB/(Vp'-½*VB)]$$

$$Toff=(⅔)*Rc*Ct*[(½)*VB/Vp'] \text{ for } Vp'>> ½*VB,$$

*Rc*=2**Rb*, and *Rc* is 300 *kohms* for *Ct*=.001 *uF* and *Ton*=100 *usecs*.

For Vp' about equal to VB, versus Vp'>>VB as is the typical operating condition, the off-time is longer than necessary which is of no consequence since the power converter spends essentially no time at this condition.

Zener diode 34*b* is a voltage limiting diode of preferably 10 volts zener voltage which, in addition to providing over-voltage protection, provides a high battery voltage shut-off of the Timer oscillator and of the boost converter. That is, if the battery voltage rises above, say 15 volts, the capacitor reset voltage Ct rises to above (⅔)*15, or above 10 volts, and the capacitor Ct can never be charged to the maximum required reset level of above 10 volts because of the zener 34*b*, so the Timer stays in the "off" state. The zener 34*a* shunting the discharge resistor 35 allows for reduced on-time (Ton) with increase in battery voltage as required. Resistor 35*a* is much less than Rb and is included to limit the maximum discharge current for higher input voltages.

Since the Timer is operated in a reverse mode, an inverting output circuit is required, comprised of a PNP transistor 37 with its emitter at the supply, its collector connected through resistor 37*a* to ground, and its base connected to the 555 Timer "Output" through a base resistor 37*b* and also connected to the emitter through a resistor 37*c*. The transistor then inverts the Timer ∂Output" node and supplies current to the driver FET 25*b* (of the boost converter switch SE) through a resistor 37*d*. In this way, the boost converter is provided with the required "on-time" drive, for say 15 amps peak current, and with the exact "off-time" drive as a function of the output voltage.

In the above equations, with Ton essentially constant for a typical automotive application, the Timer provides the exact required "off-time" Toff with output voltage, and provides the further advantage (in addition to the built-in high input voltage shut-off) that if Vp' is used for the charging voltage, then when Vp' falls below ⅔*VB' the charging capacitor 36 can never charge up and the output stays low, thus providing a built-in low output voltage shut-off. On ignition turn-on the discharge capacitor 4 is charged in a few milliseconds from the battery through a resistor and diode (see FIG. 10) to approximately battery voltage to allow capacitor 36 to charge-up and the power converter to turn-on.

Figure 10:
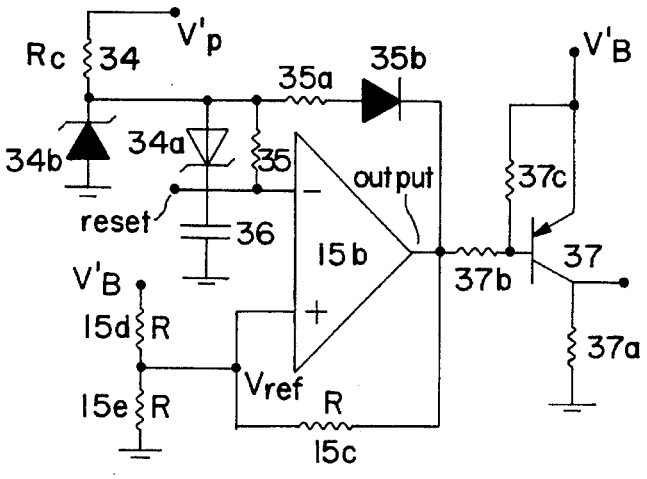
FIG. 10 is an alternative form of the preferred converter controller of FIG. 9 based on a comparator operated as an oscillator instead of a 555 Timer.

The boost converter control function disclosed is not specific to the 555 Timer, and can be applied to other oscillator configurations. Another preferred embodiment is shown in FIG. 10 which uses a comparator 15*b* as the oscillator. Like numerals correspond to like parts with respect to FIG. 9.

The main feature of the control strategy is to charge a timing capacitor Ct (36) from the power converter output voltage Vp' through a resistor Rc and have the charging time, which decreases with output voltage as required, represent the off-time Toff. The on-time Ton then represents the discharging of capacitor Ct through a resistor Rb (35). In this figure, the charging capacitor is connected to the inverting input of the comparator 15*b* (as in the "Threshold" node of the 555 Timer), and the non-inverting input has a reference voltage Vref (from divider resistors 15*c*, 15*d*, and 15*e*) which flips between approximately ⅓*VB' and ⅔*VB' (based on the values of the three resistors) depending on whether the comparator output is low or high. The remaining functions of the circuit of FIG. 10 are similar to that of FIG. 9, except that an isolation diode 35*b* is required to isolate the reference voltage VB' from the timing circuit. The "Reset" pin of the Timer 15*a* cannot be used in this application and the reset or turn-off function can be simply performed by pulling capacitor 36 to ground.

With reference to FIG. 9, one can use a fast-turn-off-circuit 17/18/19/20 for SCR 16*e* as was shown for SCRs 5*a*, 5*b* , . . . , FIG. 2, except in this case the circuit is connected to the Vc point shown. This provides a high negative pulse for the second quarter period of firing of SCR 16*e* to speed up its turn-off.

With regard to the coil assembly comprising coils T1, T2, . . . , the coils are preferably mounted directly onto the spark plugs with the discharge capacitor 4 and inductors 3*a*/3*b* preferably part of the coil assembly mounted on the engine cylinder head. Such a direct fire (distributorless) ignition does not require spark plug wires and has the minimum secondary high voltage circuit capacitance Cs, maximizing the open circuit frequency, minimizing the peak open circuit core magnetic flux density, to thus minimize the size of the magnetic cores of the coils. If spark plug wires are used for interconnecting the output of coils Ti to spark plugs, preferably either shielded wire is used as disclosed in earlier cited patents to reduce EMI, or low resistance highly inductive wires are used.

The coil of the design of FIG. 4 would be suitable for direct fire ignition except that the high voltage tower 25 would be designed to accommodate the spark plug insulator end and the plug connector which connects to connector 25*c*. With reference to FIG. 4, high voltage winding 1*b* is a multi-layer winding of preferably about 12 layers of 28 to 32 gauge wire for 10 kHz spark discharge frequency (to keep the AC factor close to one, i.e. less than 1.5). For lower frequency operation, e.g. 5 kHz, many more layers may be used which may be advantageous in reducing the output capacitance Cs.

FIG. 11 depicts a side view of an approximately 2.5 times scale drawing of a preferred toroidal gap spark plug 46 with connector 47*a*, main insulator 47*b*, shell body 47*c*, shell thread 47*d*, and center conductor 48. Preferably the center conductor 48 is copper cored near the firing end for more rapidly cooling the firing tip 48*a* which is preferably of high erosion resistant material. The end surface 49 of the plug end 48*a*, which is larger than usual, may be ceramic coated (flame sprayed) to reduce heat transfer from the combustion gases to the end 48*a*. The spark firing end (volume) is defined by the end tip 48*b* and inner surface 48*c* of the firing end 48*a* and the shell end 50. The inner surface 50*a* of the lower shell portion and the outer surface 51*a* of the insulator end section 51 define a plug end volume 52 where combustion occurs and which may produce fouling of the insulator surface 51*a*.

A key feature of this spark plug design is a firing end for minimizing fouling of the insulator surface 51*a* by extending and removing the tip 48*b* of the firing end 48*a* from the insulator end 51*b*, by extending the firing end 48*a* and tip 48*b* somewhat downwards (towards the piston) and essentially radially outwards to define a plug firing gap 53 (at the end of the air gap region 52) between tip 48*b* and spark plug threaded shell end 50, across which initial spark discharge 54 forms. The inner surface 48*c* of the firing end 48*a* then becomes the region where the spark pulses move.

FIG. 11*a* is a fragmentary, expanded side view of the firing end of the preferred toroidal gap spark plug of FIG. 11. Like numerals correspond to like parts with respect to FIG. 11. The tip 48*a*/48*b* is designed to produce the initial multiple spark kernels emanating outwards (1'/273'/4') and inward (1"/2"/3"/4") front the initial spark 54 along the inner tip surface 48*c* of end 48*a* and not along the insulator surface 51*a* to minimize fouling of the spark plug insulator 51. The spark plug end 48*a* includes a base section 48*d* for further removing the spark firing tip (defined by gap 53) from the insulator 51.

While the gap of the plug is toroidal or circular, it may also be partly circular and indexed as shown in FIG. 11*b* (also a fragmentary side view) and FIG. 11*c* (an end view). This may be especially important for engines with highly directed flows (flow vectors 55), i.e. high swirl engines, which tend to move the spark discharge in a particular sideways direction (in the direction of the flow vectors 55). By extending and orienting (indexing) the partially circular tip 48*aa* so that its end 48*bb* forms a gap 53*a* with the shell end 56, then the spark kernels 1'/2'/3'/4' will emanate outwards in the direction of the flow (55), and much more slowly inward as per FIG. 11*a*. By designing the minimum gap to occur somewhat short of the end of the elongated firing arm section 48*ee* of tip 48*aa*, then the end section 48*bb* of the arm 48*ee* can act as a rail along which the spark and flame kernels can move under the influence of the flow 55. Like numerals correspond to like parts with respect to the earlier figures.

FIG. 11*d* is a fragmentary, somewhat idealized expanded side view of the firing end of the preferred toroidal gap spark plug of FIG. 11, drawn with an approximately 5 times scale and dimensioned to bring out some of the key features of the design. Like numerals correspond to like parts with respect to FIGS. 11 and 11*a*. A key feature of the design is that the spark gap 53 of length l1 is significantly less than the gap 12 between the base outer surface 57 of the tip 48*a* and the inner shell surface 50*a* to insure that the spark always forms well away from the insulator end 51*b*. Also, the upper end 57*a* of the surface 57 of the outer conducting firing end 48*a* does not need to be located in a plane with the shell end 50 but may be some length 13 further up to further remove the insulating surface section 51*a* from the spark firing gap 53. In the figure the length 14 defines the axial extension of the tip 48*a* from the plane defined by the shell end, and D1, D2, D3 define the diameters of the center conductor 48, of the base of firing end 48*a*, and of the inner shell surface 50*a* respectively.

For a spark firing gap 11 of approximately 0.1 inch there are requirements placed on the diameters D2 and D3. For a typical 14 mm spark plug, one would require a minimum dimension for D3 of approximately 0.42" (and still have enough shell end wall thickness) and a maximum diameter for D2 of 0.18" to be able to just satisfy the 12>11 requirement. Since center conductor diameter D1 is preferably not be less than 0.1" for better tip cooling by heat conduction, then thickness of insulator section 51 is preferably less than 0.040". This may not be practical, and ceramic spray coating of say 0.025" may be employed to allow for a diameter D2 of 0.15" (and hence 12 of 0.14" for D3 equal to 0.43").

Alternatively, an 18 mm spark plug may be used (as assumed in the drawing of FIG. 11*a*) or a special design in-between size plug of say 16 mm thread be used to allow for a larger value of 12, preferably 3/16", so that a larger gap of 1/8" can be fired. The spark plug design shown in FIG. 11 was dimensioned to accommodate a special 16 mm thread 47*d* and a 3/4" hex 47*c*. Note that the spark gap is shown to be approximately 45 degrees with the vertical (or horizontal), a preferred design to allow circular movement of the spark pulsing kernels.

Figure 12:
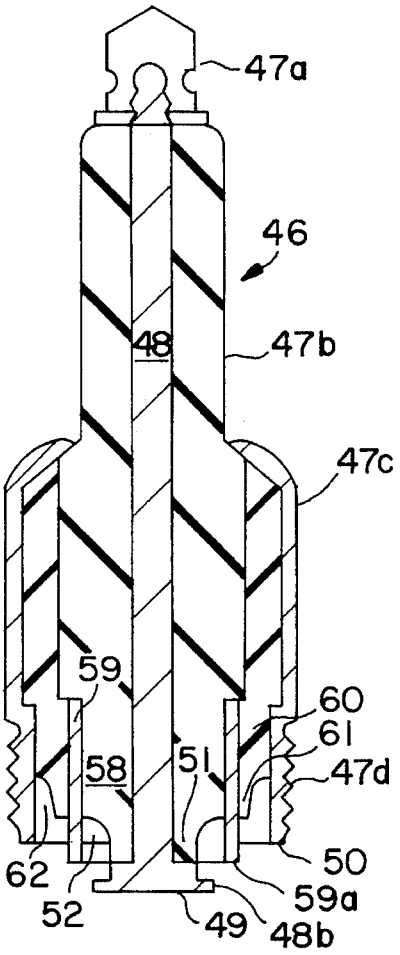
FIG. 12 is an approximately to-scale side view drawing of a novel dual gap spark plug suitable for large engines which employ large diameter spark plugs and in which ignition occurs at unusually high pressures.
Figure 12A:
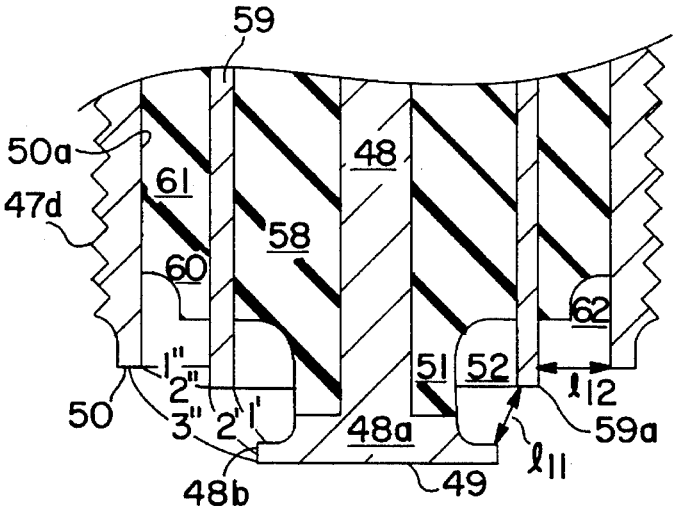
FIG. 12*a* is an approximately twice scale cross-section of the firing end of the plug of FIG. 12.

FIG. 12 is an approximately to-scale side view drawing of a novel dual gap spark plug suitable for large engines which employ large diameter spark plugs with shell thread sizes of up to approximately one inch. FIG. 12*a* is an approximately twice scale cross-section of the firing end of the plug of FIG. 12. Like numerals correspond to like parts with respect to FIGS. 11 to 11*d*.

A main feature of the plug is the dual spark gap defined by the inner insulator layer 58 separated by an intermediate essentially cylindrical electrode 59 (with tip 59*a*) from an outer insulator layer 60 with tip 61 (corresponding to the inner insulating tip 51). The outer insulator tip 61 forms a plug end volume or recess 62 (similar to recess 52) for preventing fouling of the insulator end. The spark gap is then formed by the dual gap defined by the inner electrode tip 48*b* (of electrode tip 49), the tip 59*a* of the intermediate electrode 59, and by the spark plug shell end 50.

FIG. 12*a* depicts more detail of the firing end and defines the inner spark gap length 111 and the outer gap length 112. For a multi-pulsing ignition, a first spark preferably forms along the paths 1'/1" as shown, a subsequent pulse preferably forms further out along paths 2'/2", and finally preferably across the entire gap along path 3" encompassing the two extreme electrode tips 48*b* and 50. Preferably, if practical, one or more of the electrode tips 48*b*, 59*a*, 50 is plated with radioactive material to reduce the breakdown voltage.

An important feature of this plug design, which is targeted for large bore engines operating at high peak pressures, is a voltage doubling feature of the secondary voltage Vs by appropriate design of the double gap feature. Once the inner gap 48*b*/59*a* breaks down, then the voltage on the electrodes will actually rise to a value up to two times Vs depending on the ratio of the coil output capacitance Cs and the capacitance Css defined by the outer layer 61 which is sandwiched between electrode 59, which is typically preferably about one inch long, and inner surface 50*a* of the plug threaded shell portion 47*d*. The voltage Vss after the inner gap breakdown is given approximately by:

$$Vss=2*Vs*Cs/(Cs+Css)$$

so that, for example, if Cs is 45 pF, Css is 15 pF, then Vss=1.5*Vs, to thus aid in the breakdown of the second outer gap 59*a*/50. The frequency of the enhanced voltage Vss is very high, in the megahertz range, which detracts from the enhanced voltage effect, which can be alleviated by adding a large inductance in series with the center electrode 48 of the plug, e.g. by using highly inductive suppression spark plug wire.

The key features of the present invention are summarized here and can be viewed as a voltage doubling, high power, high energy ignition system of variable spark amplitude and duration, of either pulsing or oscillating spark, with optimized compact coils designed on the basis of circuit theory for the peak output voltage and Maxwell's equations for the peak magnetic core flux density. The ignition features ignition coil assemblies with resonating inductors which can be shunted to give a very high initial open circuit high voltage frequency, or which can be used in an auxiliary circuit to produce the same result for minimum size of the coils. The initial spark pulses or oscillations comprising the spark firing train are of higher power and energy to provide more spark power with engine speed (at the shorter times available at high engine speeds) which is achieved by spark pulsing modulation, both time and speed modulation, and by circuit design. A key feature disclosed is a complete ignition system including a boost type power converter and a unique controller, a simple form of ignition controller for a ringing spark which is a hybrid arc/glow discharge spark, and preferably a toroidal or partially toroidal gap spark plug with a larger shell and extended electrodes to minimize fouling.

The ignition preferably uses compact coils with high saturation magnetic flux density core material designed on the basic principles disclosed. By suitable choice of components and design as disclosed, the ignition can be made to be more suitable for distributor ignition or for the direct fire distributorless ignition. By using an isolation switch and return diode in the recharge circuit, the ignition can be operated both in the pulsed mode and ringing mode with added power from the recharge circuit in both cases.

While the emphasis in the present disclosure was in the automotive application using a 12 volt battery, the ignition features disclosed herein can also be used with a 24 volt battery, a high voltage supply, e.g. 360 volt supply, or other power source. Furthermore, the various features disclosed can be combined in various ways depending on the specific application, and the combinations disclosed herein is not meant to be exhaustive but rather representative.

Finally, it is particularly emphasized with regard to the present invention, that since certain changes may be made in the above apparatus and method without departing from the scope of the invention herein disclosed, it is intended that all matter contained in the above description, or shown in the accompanying drawings, shall be interpreted in an illustrative and not limiting sense.

What is claimed is:

1. In a high power high energy ignition system for internal combustion engines including at least one energy storage and discharge capacitor C, at least one resonating inductor of inductance Le, one or more ignition coils Ti of primary turns Np, secondary turns Ns, and turns ratio N, where i=1, 2, 3 , . . . , and each coil Ti having a coil primary current switch means Si, and each coil having its high voltage secondary winding connected to a spark plug, the system constructed and arranged according to the transient voltage doubling formulation with doubling factor DF equal to [(N**2)*C2/C], where C2 is the coil output capacitance, and magnetic flux formulations derived from Maxwell's equations to produce very high power high energy high efficiency ignition powered by an electrical power source for supplying power to the ignition system by charging up said capacitor C, the ignition firing controlled by an ignition controller to produce ignition sparks by discharging said capacitor C through actuation of said switch means Si, the improvement wherein said system is constructed and arranged:

a) to provide, under normal operating conditions of the engine, ignition spark energy characterized by higher spark frequency and spark power during the early part of the sparking phase or spark duration to enable reduced size of the ignition coils Ti and to provide energy which changes slowly relative to engine speed, and b) to provide overall system optimization: (i) with doubling factor DF less than 0.4, and (ii) with coil core saturation flux density at normal operating temperatures to correspond approximately to the open circuit peak magnetic flux density B2[x(t0)] whose open circuit phase angle x(t0) is approximately 155 degrees at the peak of the secondary high voltage V2(0).

2. An ignition system as defined in claim 1 including a high frequency auxiliary circuit comprised of a series combination of a capacitor C11 of about half the capacitance of capacitor C, an inductor Le1 of about half the inductance Le, and a switch SS1 with one connection to ground, said series combination being in parallel with a series combination of capacitor C and inductor Le, such that on an ignition firing event switch SS1 is turned on to produce for the initial stage of a spark firing event an initial higher frequency breakdown spark of higher frequency than that of the main discharge circuit produced by discharging of capacitor C through inductor Le.

3. An ignition system as defined in claim 2 wherein said switch means Si comprises a first silicon control rectifier, SCR, switch with its cathode connected to ground and a return current switch SD connected across said first switch, return switch SD comprised of a series combination of SCR and diode, and wherein said switch means SS1 comprises a parallel combination of an insulated gate bipolar transistor, IGBT, and diode means, constructed and arranged to be triggered simultaneously with triggering of one or more coils Ti producing the initial high voltage breakdown field to produce an initial breakdown spark in a spark ignition device connected across the secondary winding of each coil Ti.

4. An ignition system as defined in claim 3 wherein one resonating inductor Le is used with more than one coil Ti with respective switch Si in series with primary winding of each coil Ti, said coils cascaded in parallel with each other with one end of their primary windings sharing a common rail point or section, the system being usable to sequentially fire said spark ignition devices when each switch Si is triggered sequentially.

5. An ignition system as defined in claim 1 further comprising high current switch control means SS constructed and arranged to controllably short out part or all of inductor Le during an early part of the firing of said ignition system.

6. An ignition system as defined in claim 1 wherein said ignition controller provides multiple spark pulses per ignition firing which are time modulated such that the spark pulsing frequency is higher at the early part of the spark firing.

7. An ignition system as defined in claim 6 wherein said spark pulses are speed modulated so that the spark pulsing frequency is higher at higher engine speeds.

8. An ignition system as defined in claim 1 wherein said ignition controller provides multiple spark pulses per ignition firing which are speed modulated such that the spark pulsing frequency is higher at higher engine speeds.

9. An ignition system as defined in claim 8 wherein the spark firing train changes from high frequency spark pulses to continuously firing spark oscillations at a high end portion of the said high engine speed range.

10. An ignition system as defined in claim 1 wherein said spark plug comprises an insulator end and firing end comprising an essentially toroidal firing zone with a shell end, a center conductor to whose bottom end is attached a firing end tip of erosion-resistant material which forms a circular toroidal spark gap of width of about 0.1" with the end of the spark plug shell and wherein the tip is extended radially and axially away from the insulator end section surrounding the center conductor to produce sparking away from the insulator end to minimize deposits on the insulator to reduce spark plug fouling.

11. An ignition system as defined in claim 10 wherein said spark gap width 11 is smaller than the radial dimension 12 between the end of the insulator end and the inner surface of the spark plug shell.

12. An ignition system as defined in claim 10 wherein the circular spark gap is at an angle of approximately 45 degrees with the vertical line defined by the length dimension of said center conductor.

13. An ignition system as defined in claim 10 wherein said tip includes a vertical metallic portion which together with said radial tip portion form a rail on which the spark can move without impinging on said insulator end section.

14. An ignition system defined in claim 13 wherein said vertical metallic portion extends from the firing end towards the insulator end up and beyond the plane defined by the shell end.

15. An ignition system as defined in claim 10 wherein said insulator end section is thin and of dimension of about 0.025" thickness.

16. An ignition system as defined in claim 10 wherein inner diameter of the shell end is approximately 0.4" or greater.

17. An ignition system as defined in claim 10 wherein said tip is partially circular to form a spark gap with one side of the plug shell so that the plug is capable of being appropriately indexed and oriented with respect to the air-flow vectors produced in an engine cylinder with its piston near top center and when so indexed and oriented and the plug is fired, the spark discharge moves outwards and away from the center of the spark plug to minimize plug fouling.

18. An ignition system as defined in claim 1 wherein said power source includes a boost power converter comprising an inductor Lb for storing magnetic energy Eb front a battery or other voltage source of voltage Vb and a switch SE for controlling the storage of said energy Eb and delivering it to a capacitive load at a higher voltage Vc.

19. An ignition system as defined in claim 18 including a power converter controller comprising controlled oscillator means for turning said switch SE on and off for durations Ton and Toff respectively, the oscillator including a timing capacitor Ct which is charged up to a high threshold and discharged through a discharge point to a low threshold to define the two periods Toff and Ton, capacitor Ct being charged through a resistor Rc connected at one end to said discharge point and to said capacitive load at voltage Vc to define the off-time Toff which decreases with increased voltage Vc, and timing capacitor Ct discharging through a resistor Rb connected between capacitor Ct and the discharge point to define the on-time Ton.

20. An ignition system as defined in claim 19 wherein a voltage limiting zener is connected to the discharge point with its anode to ground which provides over-voltage protection and a high battery voltage shut-off, and a zener is connected across resistor Rb for operation of the circuit and for providing a reduced Ton time with increased battery voltage Vb.

21. An ignition system as defined in claim 20 wherein said controlled oscillator is built on a 555 Timer device.

22. An ignition system as defined in claim 20 wherein said controlled oscillator comprises a comparator constructed and arranged to operate as an oscillator.

23. An ignition system as defined in claim 18 wherein said power converter is a boost converter and said switch comprises a main current carrying switch and a driver switch and wherein said inductor Lb and said main switch SE are connected in series with said high voltage side Vb of said battery with switch SE making a connection to the return side of the battery, and wherein said inductor has a tap for providing the driver switch with an additional drive voltage of about one volt above the voltage across said main switch, and wherein a connection is made from the intersection of the inductor and main switch SE to a load capacitor through an isolation means.

24. An ignition system as defined in claim 23 including a diode as a principal isolation component.

25. An ignition system as defined in claim 23 including a recharge circuit comprised of a recharge capacitor which is said load capacitor, a recharge inductor, and a diode with said recharge inductor isolated from said load capacitor by an isolation switch which is normally closed as long as the voltage on the load capacitor is above some value a fraction of the maximum value Vc.

26. An ignition system of claim 23 wherein said isolation means comprises a diode means in series with an isolation switch SI which is turned on for at least a portion of the time when the switch SE is turned off to allow energy stored on said inductor Lb to be delivered to said capacitor load.

27. An ignition system as defined in claim 1 wherein said power source includes an alternative boost power converter comprised of an inductor Lb for storing magnetic energy Eb from a battery or other voltage source of voltage Vb and a switch SEI for controlling the storage of said energy Eb and delivering it to a capacitive load at a higher voltage Vc and for providing isolation, wherein said power converter comprises series connection of said voltage source, said switch SEI, and said inductor whose one end is connected to the return side of voltage source, and the load capacitor is connected at the intersection of the switch SEI and the inductor.

28. An ignition system as defined in claim 27 wherein a diode is connected at the output side of load capacitor with its anode to ground to provide a complete path for power converter operation, and wherein said load capacitor is a recharge capacitor of a recharge circuit including a recharge inductor and a diode.

29. The ignition system defined in claim 27 including an inductor of inductance Lb' less than Lb located between the collector of main transistor switch SEI and the collector of driver transistor switch SES whose emitter is connected to the base of main switch SEI wherein said switches SEI and SES are PNP transistors.

30. The ignition system as defined in claim 29 wherein said drive transistor SES is controlled by an NPN control transistor whose emitter is grounded and whose collector is connected to the base of switch SES through a resistor.

31. An ignition system as defined in claim 29 wherein said inductor Lb is also part or all of the inductor of a recharge circuit and wherein said load capacitor C is a recharge capacitor of said ignition circuit.

32. A high power high energy ignition system including one or more spark plugs for producing ignition sparks wherein said spark plug comprises an insulator end and firing end comprising an essentially toroidal firing zone with a shell end, a center conductor to whose bottom end is attached a firing end tip of erosion-resistant material which forms a circular toroidal spark gap of width of about 0.1" with the end of the spark plug shell and wherein the tip is extended radially and axially away from the insulator end section surrounding the center conductor to produce sparking away from the insulator end to minimize deposits on the insulator to reduce spark plug fouling.

33. The ignition system as defined in claim 32 wherein tips defining said spark firing gap are plated with radioactive material.

34. A high power high energy ignition system including one or more spark plugs for producing ignition sparks wherein said spark plug comprises an insulator end and firing end comprising an essentially toroidal firing zone between a center conductor, an intermediate cylindrical conductor, and a shell end to form a concentric dual spark gap firing end with inner gap defined between said center conductor to whose bottom end is attached a firing end tip of erosion-resistant material which forms a circular toroidal spark gap with said intermediate cylindrical conductor end, and with outer gap defined between the tip of said cylindrical intermediate conductor of the spark plug shell end.

35. The ignition system as defined in claim 34 wherein tips defining said dual spark firing gap are plated with radioactive material.

36. The ignition system as defined in claim 34 wherein a high inductance spark plug wire is employed with said dual gap plug.

* * * * *